United States Patent [19]

Bailey

[11] Patent Number: 4,718,564

[45] Date of Patent: Jan. 12, 1988

[54] PORTABLE CONSTRUCTION HOIST

[76] Inventor: Jonathan L. Bailey, 6939 LaBoiteaux Ave., Cincinnati, Ohio 45239

[21] Appl. No.: 896,607

[22] Filed: Aug. 13, 1986

[51] Int. Cl.[4] ..... B66C 23/18

[52] U.S. Cl. ..... 212/179; 212/254; 414/11

[58] Field of Search ..... 212/179, 223, 244, 254, 212/253; 414/10, 11

[56] References Cited

U.S. PATENT DOCUMENTS

| | | | |
|---|---|---|---|
| 198,895 | 1/1878 | Meharry | 212/254 |
| 2,443,349 | 6/1948 | Foster | 414/11 |
| 2,513,403 | 7/1950 | Dakin | 212/179 |
| 3,178,038 | 4/1965 | Love | 414/11 |
| 3,978,989 | 9/1976 | Avila | 212/179 |
| 4,620,693 | 11/1986 | Vialars et al. | 52/120 |

FOREIGN PATENT DOCUMENTS

| | | | |
|---|---|---|---|
| 630778 | 12/1927 | France | 212/254 |
| 13243 | 2/1977 | Japan | 212/179 |

*Primary Examiner*—Joseph F. Peters, Jr.
*Assistant Examiner*—Thomas J. Brahan
*Attorney, Agent, or Firm*—Wood, Herron & Evans

[57] ABSTRACT

A portable construction hoist adapted to mount flush against the inside surface of a wall. A telescoping mast carries a removeably mounted winch with a remote control pendant. A freely rotatable boom is removeably mounted to the top of the mast. As the boom is rotated, an object which has been raised along the outside of the wall to which the hoist is secured can be brought around and lowered inside the perimeter of the building. The telescoping mast and removable boom and winch facilitate transportation and storage.

4 Claims, 3 Drawing Figures

PORTABLE CONSTRUCTION HOIST

FIELD OF THE INVENTION

The present invention relates to a hoist for lifting objects. More particularly, the invention relates to a hoist having a freely rotatable boom for raising structural members such as roof trusses or other loads at a building site.

BACKGROUND OF THE INVENTION

Modern building construction practices make extensive use of prefabricated structural members which are hauled to the construction site ready to be moved into place and joined to form a unified framework. In the housing construction field, the use of prefabricated roof trusses is commonplace even in so-called "custom built" homes. While prefabricated members offer many advantages, their handling presents contractors with serious difficulty. This is particularly true in the case of small contractors who often work with small crews and who cannot afford heavy equipment for lifting prefabricated members which are often heavy and awkward to handle.

For example, a conventional house requires a specially constructed "end" truss weighing up to several hundred pounds positioned at each end of the roof. In addition to the end trusses, the roof of a typical four bedroom size house is supported by 25–30 evenly spaced "intermediate" trusses lying between the end trusses. Each "intermediate" truss weighs about 120 pounds. Both types of trusses have a bulky outline in the form of an isoceles triangle which is commonly on the order of 36 feet long and 10 feet high. Each truss must often be lifted a height of two stories from ground or truck level to a position spanning and resting upon the tops of the front and rear walls of the house. Accomplishing this task in a manner which is relatively fast, easy, safe and inexpensive presents the homebuilder with a considerable challenge.

Many contractors raise roof trusses using a mobile crane of the type having an extendable boom mounted on the bed of a truck. The crane cable is looped around the apex of the truss which can then be lifted and brought down across the top of the front and rear wall by the crane operator. Some contractors lift trusses one at a time and use the crane to hold them upright as they are positioned and nailed in place. Others bring up several trusses in a single lifting operation and lay the trusses on their sides spanning the walls in an imbricated stack along the length of the house. Workers then move along the length of the stack, successively tipping the topmost truss upright and nailing it into place. While such methods are otherwise satisfactory, the mobile crane which is required is quite expensive. In addition to its purchase price, a truck-mounted crane involves expenses for such items as maintenance, vehicle registration and insurance. To store the crane when not in use, proper off-street parking space must often be rented. Since the crane is only in use for a fraction of the total time required to build a house, the purchase of a truck-mounted crane is usually not economically justifiable except by larger contractors who work on several projects at once and keep such expensive equipment in service a fair amount of the time. Other homebuilders are relegated to either renting a truck-mounted crane or to resorting to manual labor or makeshift hoists. Renting a truckmounted crane is often not a satisfactory solution since it is also quite expensive. Also, a rental crane may not be available in a particular area or at the time it is needed. Manual and makeshift methods are labor intensive, slow and potentially hazardous.

Accordingly, there is a need in the construction industry for a hoist which is affordable, fast, simple and safe to use and which is readily transportable using a conventional van or pickup truck. Furthermore, there is a need for such a hoist which is structurally simple, relatively compact for storage and which requires little maintenance.

SUMMARY OF THE INVENTION

The present invention satisfies the above needs by providing a highly versatile portable hoist which is especially well suited for raising roof trusses at a residential construction site. The hoist of the invention includes a vertical mast which is preferably telescopically adjustable to a desired height. The lower end of the mast is attached to a base adapted to anchor the hoist to a floor while at least a portion of the vertical mast mounts flush with and is secured to a wall or other fixed vertical structure of the building in which the hoist is used, thereby taking advantage of the building for support. Above the base, a winch is secured to the mast. The winch is preferably an electric motor driven type having a remote control pendant connected to it by way of a cable of sufficient length to permit the hoist to be operated by a worker standing on top of a wall of the house. The upper end of the hoist is connected to a freely rotatable horizontal boom having a pulley at each end for carrying the winch cable. When the hoist is mounted near the center of an end wall, the boom readily pivots to bring a truss which has been raised along the outside of the wall to an inside position so that the truss can be set upon the tops of the front and rear walls. The mast is readily collapsable and the winch and boom can be removed for ease of transportation and storage.

The hoist of the present invention is particularly well suited to the task of raising prefabricated construction members such as roof trusses and is described below in the context of such use. It must be noted however that the use described is merely illustrative and not limiting of the invention. The hoist of the invention is a highly versatile apparatus and may be used to great advantage for many types of lifting and material handling tasks.

DESCRIPTION OF THE PREFERRED EMBODIMENT

Figure 1:
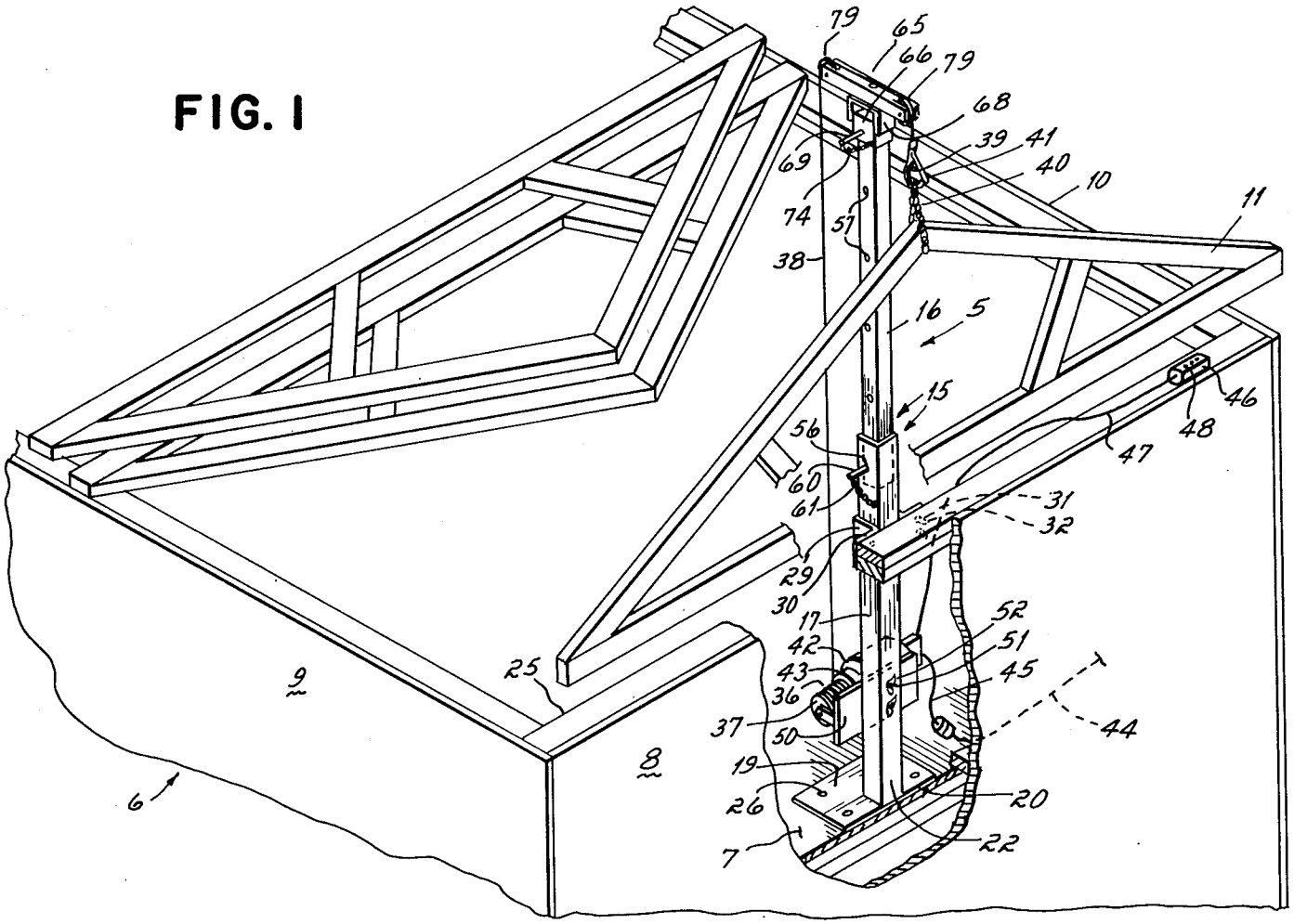
FIG. 1 is a perspective view of the hoist of the invention showing the hoist being used to lift a roof truss.

Referring to FIG. 1, a preferred form of a hoist 5 embodying the present invention is shown mounted in a building 6 under construction which includes an upper floor 7, end wall 8 and front and rear walls 9 and 10, respectively. Hoist 5 is shown lifting a truss 11. Hoist 5 includes a telescoping vertical mast 15 having an upper, male section 16 extendably received within a lower, female section 17. Each section 16, 17 is preferably made of twelve foot lengths of tubular steel stock of rectangular cross section having a wall thickness appropriate for the alloy used and the load bearing capacity required.

The lower end of female section 17 is welded completely around its periphery to a rectangular base 19 having an inside edge 20. Female section 17 has an outside face 22 which is centered with the inside edge 20 of base 19 and welded vertically flush therewith so that the edge 20 of base 19 and the outside face 22 of the female section can be mounted flush against the inside surface 25 of end wall 8. Mounting holes 26 are provided in base 19 for securing hoist 5 to floor 7 using lag bolts (not shown). Hoist 5 is further stabilized by means of a rigid, steel strap 29 having ears 30 with holes 31 pierced therethrough. Strap 29 is used to secure the upper portion of female section 17 to the upper plate of the end wall 8 of building 6 using lag bolts 32.

Located immediately above base 19, female section 17 carries a winch 36 having a cable reel 37 with a sufficient length of steel cable 38 wound thereon. The free end of cable 38 is equipped with a hook 39 for attaching the cable to a chain 40. Preferably, hook 39 includes a spring-loaded guard 41 to prevent chain 40 from unintentionally disengaging hook 39. Winch 36 is powered by a reversible electric motor 42 which is connected to cable reel 37 through a gearbox 43. Motor 42 is preferably a 115 volt A.C. motor since such power sources are generally available at residential construction sites. Motor 42 may be connected to a suitable power source 44 by way of a power cord 45. Motor 42 is also connected to a control pendant 46 by way of control cord 47 of sufficient length to permit winch 36 to be controlled by an operator standing atop the end wall 8 of building 6. Control pendant 46 includes switches 48 for turning winch 36 on and off and for selecting forward or reverse operation. Winch 36 is secured to a mounting plate 50 which in turn is removeably attached to the female section 17 of mast 15 by way of bolts 51 secured with wing nuts 52. The female section 17 of mast 15 also includes a through hole 56 near its upper end. Through hole 56 is adapted to mate with any one of a plurality of equidistantly spaced height adjustment holes 57 located along the length of the male section of 16 as shown. The height of mast 16 is conveniently adjusted by aligning through hole 56 with a selected height adjustment hole 57 and securing the mast 16 at the desired height by passing a locking pin 60 through holes 56 and 57. Locking pin 60 is preferably attached to female section 16 in the area of through hole 56 by means of a length of chain 61 to avoid its being lost. The upper end of the male section 16 of mast 15 is connected to a rotatable, horizontally disposed boom 64 about fourteen inches long which is centered about mast 15.

Figure 3:
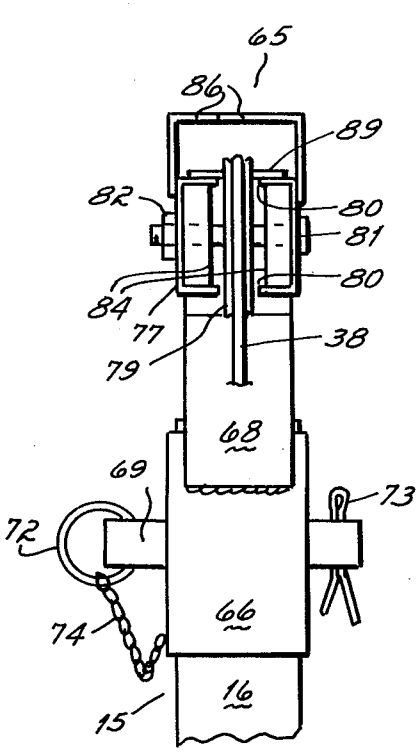
FIG. 3 is an end view of the rotatable horizontal boom of the hoist of the invention viewed from line 3—3 of FIG. 2.
Figure 2:
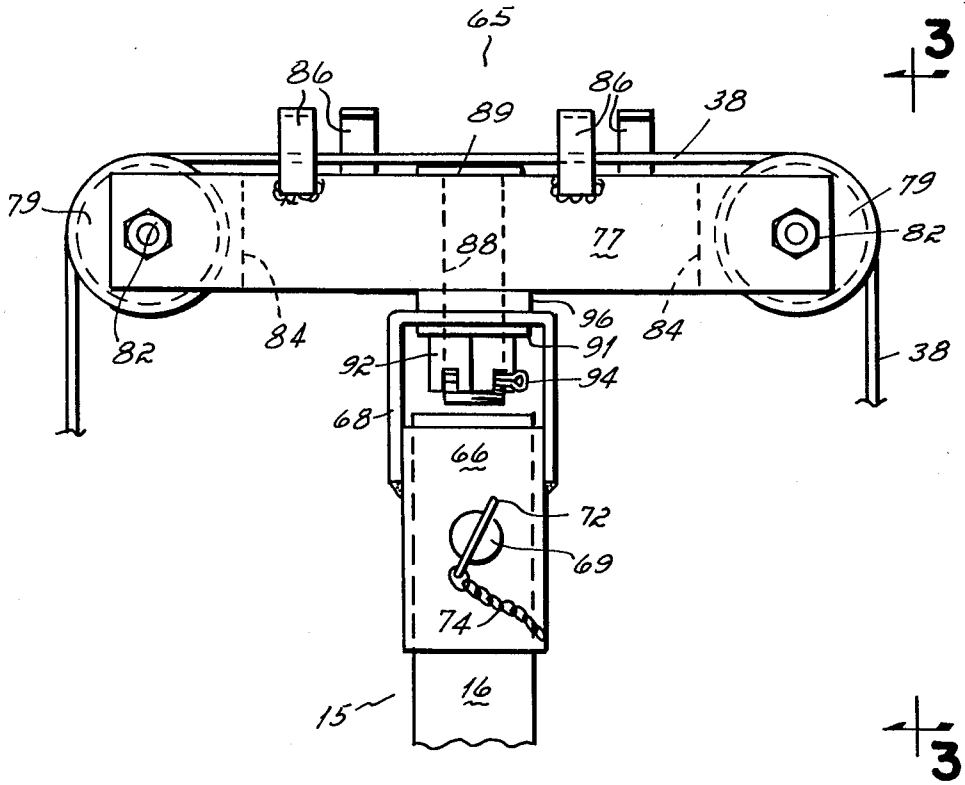
FIG. 2 is a side view showing the rotatable horizontal boom of the hoist of the invention.

The preferred construction of rotatable boom 65 is shown in further detail in FIGS. 2 and 3 to which reference is now made. Boom 65 is connected to the male section 16 of mast 15 by means of a cap 66 to which is welded a U-shaped saddle 68 as shown. Cap 66 is preferably made of a short length of the same tubular steel stock from which the female section 17 of mast 15 is constructed. In order to facilitate removal of boom 65 for compact storage of hoist 5, cap 66 is removeably joined to the male section 16 of mast 15 by means of a pin 69 which is held in place by a ring 72 at one end and a cotter pin 73 on the other. To prevent pin 69 from being lost, it is preferably secured to cap 66 by a short length of chain 74.

Rotatable boom 65 also includes a horizontally disposed tubular member 77 of square cross section having a pulley 79 rotatably mounted at each end for carrying cable 38. The free end of cable 38 is routed upward from winch 36, over one pulley 79, across the top of boom 65, over the second pulley 79 and down. It can be appreciated this routing arrangement in combination with the fact that boom 65 is centered atop mast 15 provides an important advantage. Namely, when a load is attached to the free end of cable 38, the downward moment applied to one end of boom 65 due to the load tends to be at least partially offset by the moment created tension in cable 38 directed toward the winch 36. This at least partial balancing of the moments acting on boom 65 eliminates the need for additional structural support of the load bearing end of boom 65.

Each pulley 79 is received partially within a slot 80 in the center of each end of member 77 as shown. Each pulley 79 rotates on a socket head cap screw 81 secured by a nut 82. As best seen in FIG. 3, each socket head cap screw 81 is supported by the outer walls of tubular member 77 as well as by a pair of plates 84 welded inside tubular member 77 on both sides of slots 80. The top of tubular member 77 includes a number of opposed, inverted L-shaped cable guides 86 which help prevent cable 38 from jumping off of pulleys 79. A large bolt 88 having a head 89 is used to rotatably secure tubular member 77 to saddle 68. Bolt 88 passes through tubular member 77 which is held by head 89 and through a hole 90 in the top of saddle 68. Bolt 88 is secured to saddle 68 by means of a large washer 91 retained by a castle nut 92 which is prevented from loosening by a cotter pin 94. To insure smooth rotation of boom 65, about mast 15, a thrust bearing 96 is interposed between tubular member 77 and the top of saddle 68 as shown.

When hoist 5 is to be employed for lifting roof trusses it is preferably used at a phase in construction when all interior and exterior wall frames, partitions and subfloors have been installed including, the end, front and rear walls 8, 9 and 10 respectively of the upper floor 7 of building 6. Hoist 5 is most conveniently carried to the construction site in a compact, partially disassembled state with winch 36 and rotatable boom 65 removed from mast 15. Mast 15 is stored and transported in a collapsed condition with male section 16 nesting completely within female section 17 and held in place by locking pin 60.

Hoist 5 is prepared for use by removing locking pin 60, extending mast 15 to the desired height and reinstalling locking pin 60 into the hole 56 in female section 16 and any aligned, height adjustment hole 57 in male section 17. Mast 15 should be extended to a length sufficient to raise the bottom of the roof truss several feet above the top of the wall 8. Winch 36 is mounted to female section 17 using bolts 51 secured by wing nuts 52 and boom 65 is attached to the upper end of male section 16 by attaching cap 66 using pin 69 which is retained by installing cotter pin 73. Cable 38 is then routed over both pulleys 79 as described above and chain 40 is connected to hook 39.

Hoist 5 is then located in an upright position, flush against the center of end wall 8 as shown in FIG. 1. To hold the mast 15 in place, strap 29 is installed to hold the upper portion of female section 17 firmly against end wall 8. This is accomplished by driving lag bolts 32 through the holes 31 in the ears 30 of strap 29 to engage the double upper plate of end wall 8 as shown. If necessary, wall 8 should be braced as required. Hoist 5 is then further secured by installing lag bolts (not shown) through mounting holes 26 to anchor the base 19 of mast 15 firmly to floor 7. After power cord 47 is connected to a proper electrical power source 44, hoist 5 is ready for operation.

In operation, the operator of the hoist 5 generally stands atop end wall 8 holding the control pendant 46. To make a lift, the operator grasps cable 38 and rotates boom 65 so that the end of boom 65 carrying the end of cable 38 to which hook 39 and chain 40 are attached extends over end wall 8, outside building 6. The operator then actuates the proper switch 48 on control pendant 46 to cause chain 8 to be lowered to an assistant on the ground. The assistant loops chain 40 around the apex of the truss which is then lifted by winch 36 under the control of the operator. When the bottom of the truss is lifted to a level above the top of end wall 8, the operator stops winch 36. To bring the truss to a position on the inside of the building 6, spanning the front and rear walls 9 and 10, the operator grasps the truss and swings it toward the inside of building 6. With very little effort on the part of the operator, the load is brought to the desired inside position as boom 65 rotates freely and smoothly, following the truss. When boom 65 has rotated 180°, the truss is lowered, unchained and brought to rest lying across the front and rear walls 9 and 10 of building 6 supported by walls 9 and 10 as well as by the tops of interior partitions (not shown). If desired, a number of trusses can be lifted at once, as long as the safe lifting capacity of the hoist 5 is not exceeded. As additional trusses are raised, they are arranged by one or more workers assisting the operator on top of building 6 to form an imbricated stack, ready to be tilted upright one at a time and nailed in place.

From the foregoing, it can be appreciated that the hoist 5 of the invention eliminates the need for expensive heavy equipment such as a truck-mounted crane. In addition to being highly effective and easy to use, hoist 5 offers a number of other important advantages. By virtue of its telescoping mast 15 and removeable winch 36 and boom 65, hoist 5 is highly compact when disassembled and therefore, easy to transport and store. Each major component, including winch 36, boom 65, and mast sections 16 and 17 is sufficiently light to be carried by a single worker from a pickup truck or van to the upper floor 7 of the building 6 where hoist 5 may be conveniently assembled. Because base 19 is bolted to floor 7 and the female section 16 of mast 15 mounts flush against and is secured to end wall 8, hoist 5 advantageously utilizes the structure of building 6 for support and stabilization. Accordingly, there is no need for a large, cumbersome base structure or supplemental mast support members. The balanced geometry of hoist 5 obviates the need for struts to support boom 65. Boom 65 is relatively short and centered on mast 15 and cable 38 is routed over pulleys 79 at each end of boom 65. With this arrangement, the tension in the portion of cable 38 between one pulley 79 and the winch 36 generates a moment which tends to offset the moment acting on boom 65 due to the weight of the load. In addition, the freely rotatable boom 65 permits a load which has been raised along the outside of building 6 to be moved manually, with a minimum of effort, to a position inside the perimeter of building 6 to be subsequently lowered to a rest position with the aid of winch 36. This obviates the need for a worker to risk a strain injury or a fall by struggling to pull the load to an inside position.

While the hoist described above constitutes the preferred embodiment of the invention, it is recognized that the invention can be carried out in other specific ways than those herein set forth without departing from the scope of invention. The above embodiment is therefore to be considered in all respects illustrative and not restrictive or limiting of the invention defined by the appended claims.

What is claimed is:

1. A portable hoist for lifting loads such as roof trusses at the site of a building under construction, said building having at least a wall and a floor inside the wall, said hoist comprising:

(a) a base adapted to be disposed inside the wall to support said hoist upon the floor, said hoist being securable to at least one of the wall and the floor;

(b) a vertical mast telescopically adjustable to a desired working height, said mast having an upper end and a lower end, said lower end of said mast being attached to said base in a manner and location permitting said mast to be positioned substantially flush against the inside of the wall;

(c) securement means for securing said mast to the wall to stabilize the hoist;

(d) an electric winch having a cable wound thereon for lifting objects, said winch being adapted to be removeably mounted to one of said mast and said base at a location adjacent said lower end of said mast, and (e) a horizontal boom having a pulley at each end for carrying said cable, the length of said boom being sufficient to extend outside the wall so that a load raised from outside the wall can be lifted above the wall and swung into a position inside the wall, said boom being freely rotatably and removeably secured near the center thereof to said upper end of said mast said boom being short relative the working height of said mast so that the weight of said load is substantially counterbalanced by the tension in the portion of said cable running between said winch and one of said pulleys.

2. A portable hoist as claimed in claim 1 wherein said base is adapted to secure said hoist to a floor of the building.

3. A portable hoist as claimed in claim 1 wherein said winch includes remote control means.

4. A portable hoist as claimed in claim 3 wherein said remote control means comprises a control switch pendant connected to said winch by a control cord.

* * * * *

UNITED STATES PATENT AND TRADEMARK OFFICE

CERTIFICATE OF CORRECTION

PATENT NO. : 4,718,564

DATED : January 12, 1988

INVENTOR(S) : Jonathan L. Bailey

It is certified that error appears in the above-identified patent and that said Letters Patent is hereby corrected as shown below:

Col. 3, line 54, remove "64" and insert thereat --65--.

Signed and Sealed this

Twenty-first Day of March, 1989

*Attest:*

*Attesting Officer*

DONALD J. QUIGG

*Commissioner of Patents and Trademarks*